US010240734B1

(12) United States Patent
Hwang

(10) Patent No.: US 10,240,734 B1
(45) Date of Patent: Mar. 26, 2019

(54) OUTDOOR LAMP CAPABLE OF CHANGING COLORS

(71) Applicant: METROMAX AMERICA CORPORATION, Rowland Heights, CA (US)

(72) Inventor: Christina Hwang, Rowland Heights, CA (US)

(73) Assignee: METROMAX AMERICA CORPORATION, Rowland Heights, CA (US)

( * ) Notice: Subject to any disclaimer, the term of this patent is extended or adjusted under 35 U.S.C. 154(b) by 0 days.

(21) Appl. No.: 15/943,744

(22) Filed: Apr. 3, 2018

(51) Int. Cl.

| | |
|---|---|
| ***F21V 31/00*** | (2006.01) |
| ***F21S 4/10*** | (2016.01) |
| ***F21S 10/02*** | (2006.01) |
| ***F21V 9/40*** | (2018.01) |
| ***H05B 33/08*** | (2006.01) |
| ***F21V 21/30*** | (2006.01) |
| *F21Y 115/10* | (2016.01) |
| *F21V 19/00* | (2006.01) |
| *F21W 131/10* | (2006.01) |

(52) U.S. Cl.
CPC ..... *F21S 10/02* (2013.01); *F21V 9/40* (2018.02); *F21V 21/30* (2013.01); *H05B 33/0857* (2013.01); *F21V 19/001* (2013.01); *F21W 2131/10* (2013.01); *F21Y 2115/10* (2016.08)

(58) Field of Classification Search
CPC .. F21S 10/02; F21V 21/30; F21V 9/40; F21V 19/001; H05B 33/0857; F21W 2131/10; F21Y 2115/10
See application file for complete search history.

(56) References Cited

U.S. PATENT DOCUMENTS

| | | | | |
|---|---|---|---|---|
| 8,534,867 | B1 * | 9/2013 | Beadle | F21V 17/002 362/153.1 |
| 9,173,257 | B2 * | 10/2015 | Cubias | H05B 33/0809 |
| 2012/0020060 | A1 * | 1/2012 | Myer | F21S 2/00 362/183 |
| 2012/0243213 | A1 * | 9/2012 | Chen | H05B 33/0809 362/183 |
| 2012/0327639 | A1 * | 12/2012 | Chen | F21S 9/035 362/183 |
| 2015/0043200 | A1 * | 2/2015 | Wilson | F21S 9/035 362/145 |
| 2017/0241601 | A1 * | 8/2017 | Li | F21K 9/232 |
| 2017/0336063 | A1 * | 11/2017 | Leung | F21S 4/10 |

* cited by examiner

*Primary Examiner* — Tracie Y Green
(74) *Attorney, Agent, or Firm* — Bacon & Thomas, PLLC

(57) ABSTRACT

An outdoor lamp capable of changing colors includes a support member, a lamp holder disposed on the support member, and an LED light module disposed in the lamp holder. The LED light module includes at least one PCBA (printed circuit board assembly) arrayed with a plurality of LED groups. Each of the LED groups is composed of at least one white/warm white LED and at least one RGB LED adjacent to each other. Each of the white/warm white LED and the RGB LED can emit light simultaneously or individually. When the RGB LED emits light to change colors, the luminous flux of the entire LED light module can be improved by the aid of the white/warm white LED, and a color gradient effect is generated.

10 Claims, 5 Drawing Sheets

OUTDOOR LAMP CAPABLE OF CHANGING COLORS

FIELD OF THE INVENTION

The present invention relates to an LED outdoor lamp, and more particularly to an outdoor lamp capable of changing colors. The outdoor lamp comprises an LED light module. The LED light module includes at least one PCBA (printed circuit board assembly) arrayed with a plurality of LED groups. Each of the LED groups is composed of at least one white/warm white LED and at least one RGB LED adjacent to each other. The luminous flux of the entire LED light module is improved through the white/warm white LED to assist the RGB LED.

BACKGROUND OF THE INVENTION

Light emitting diodes (LEDs) are widely used in various types of lighting fixtures due to the characters of energy saving, light weight, and compactness. In recent years, high-power LED, white/warm white LED and RGB LED technology have been developed, gradually replacing traditional light-emitting devices. LEDs have been applied to industry, home lighting, traffic roads, etc.

In recent years, most of outdoor lamps used in gardens, homes, outdoor restaurants or outdoor recreation sites use RGB LEDs as a light-emitting module, namely, color-changing outdoor lamps. During operation, different colors can be changed through RGB LEDs to generate different visual effects.

The above-mentioned color-changing outdoor lamp has the effect of changing colors. The RGB LED uses the principle of mixing red, green and blue to change colors. When the RGB LED is driven with a high luminous flux to emit colored light, the color is not obvious. Only when the luminous flux is low, the RGB LED can generate a more obvious color-changing effect.

In other words, the luminous flux must be low for the outdoor lamp with RGB LEDs to generate a more obvious color-changing effect. This is the shortcoming of the color-changing outdoor lamp. Accordingly, the inventor of the present invention has devoted himself based on his many years of practical experiences to solve these problems.

SUMMARY OF THE INVENTION

In view of the above problems, the primary object of the present invention is to provide an outdoor lamp capable of changing colors. The outdoor lamp not only solves the problem that the luminous flux of the outdoor lamp is not enough but also allows the outdoor lamp to have a color gradient effect when changing colors.

In order to achieve the aforesaid object, the outdoor lamp capable of changing colors of the present invention comprises a support member, a lamp holder disposed on the support member, and an LED light module disposed in the lamp holder. The LED light module includes at least one PCBA (printed circuit board assembly) arrayed with a plurality of LED groups. The PCBA is electrically connected to an LED driver. Each of the LED groups is composed of at least one white/warm white LED and at least one RGB LED adjacent to each other. The LED driver drives and controls each of the white/warm white LED and the RGB LED to emit light simultaneously or individually. When the LED driver drives and controls the RGB LED to emit light in a fixed color manner or in a color-changing manner, the luminous flux of the LED light module is increased through the white light/warm white light emitted by the white/warm white LED, and the LED light module generates a color gradient effect.

Compared with the prior art, in the outdoor lamp of the present invention, each of the LED groups of the LED light module is composed of at least one white/warm white LED and at least one RGB LED adjacent to each other. When the RGB LED emits light in a fixed color manner or in a color-changing manner, the luminous flux of the LED light module is increased through the white light/warm white light emitted by the white/warm white LED, thereby overcoming the problem of dusk because the luminous flux of the conventional outdoor lamp is not enough. With the configuration of the number of white/warm white LEDs and RGB LEDs, the colored light is presented in a gradient effect.

DETAILED DESCRIPTION OF THE PREFERRED EMBODIMENTS

Embodiments of the present invention will now be described, by way of example only, with reference to the accompanying drawings.

Figure 1:
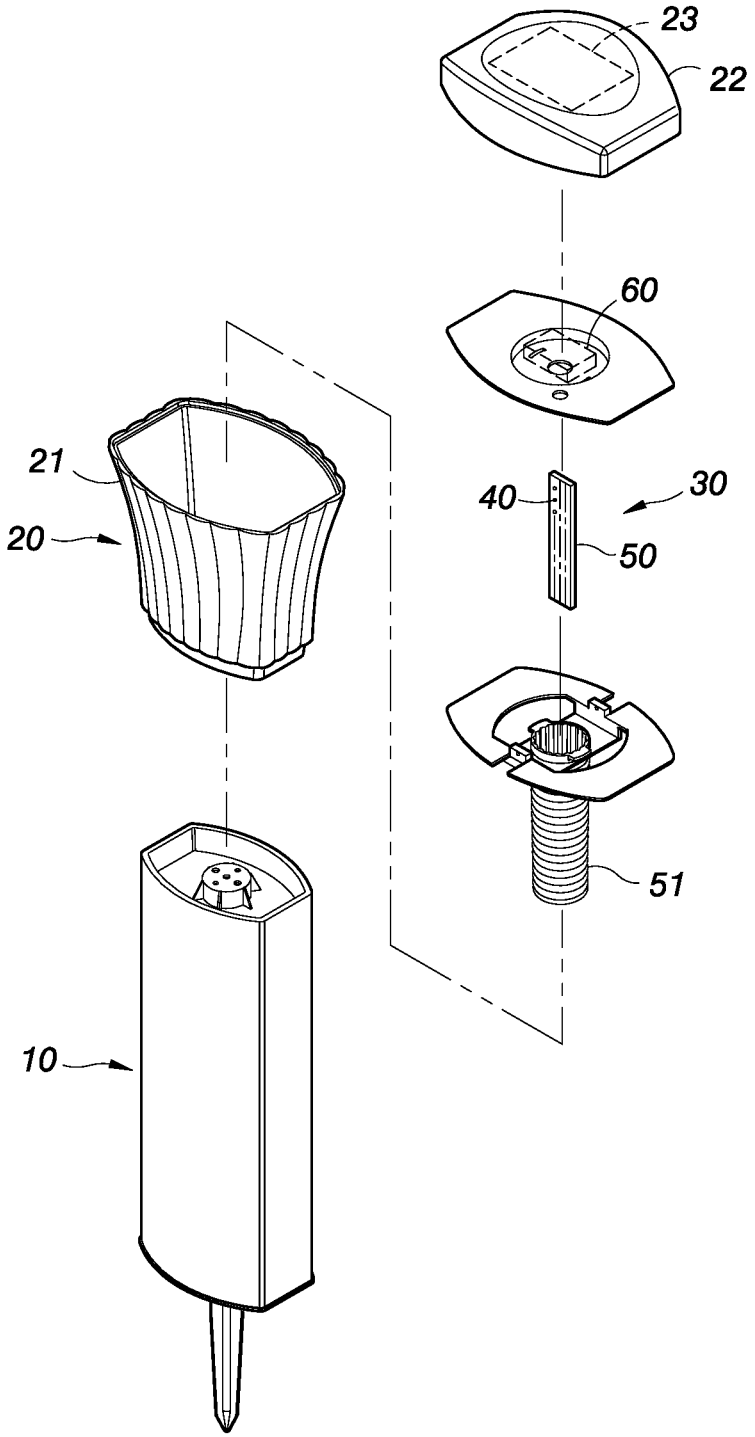
FIG. 1 is an exploded view in accordance with a preferred embodiment of the present invention.
Figure 2:
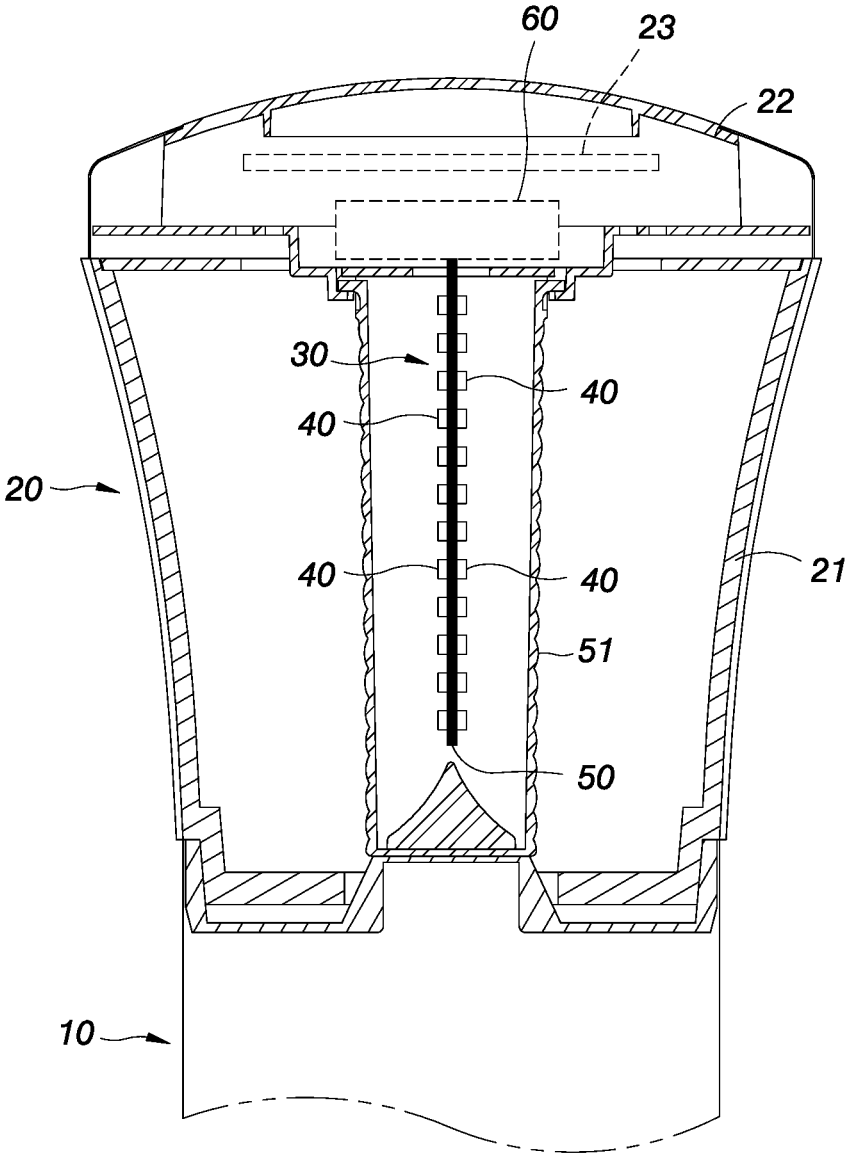
FIG. 2 is a cross-sectional view in accordance with the preferred embodiment of the present invention.

As shown in FIG. 1 and FIG. 2, an outdoor lamp capable of changing colors in accordance with the present invention comprises a support member 10, a lamp holder 20 disposed on the support member 10, and an LED light module 30 disposed in the lamp holder 20. The LED light module 30 includes at least one PCBA (printed circuit board assembly) 50 arrayed with a plurality of LED groups 40. The PCBA 50 is electrically connected to an LED driver 60 and driven by the LED driver 60, enabling the plurality of LED groups 40 on the PCBA 50 to emit light.

As shown in the figures, the support member 10 has a bottom portion in the form of a rod to be fixed to the ground. The lamp holder 20 includes a light-pervious lampshade 21 disposed on the top of the support member 10 and a cover 22 that covers the top of the light-pervious lampshade 21. In practice, the lamp holder 20 may be mounted to a bracket (not shown) on a wall or hung on a building or other objects, without using the support member 10.

In order to save energy and facilitate installation, the top of the cover 22 is provided with a solar panel 23, so that the LED light module 30 does not need to be connected with a power cable. However, the LED light module 30 may be connected with a power cable (not shown) to meet the needs of the installation site. In addition, the LED driver 60 is disposed between the top of the light-pervious lampshade 21 and the cover 22 in a hidden manner to avoid affecting the appearance.

The PCBA 50 of the LED light module 30 is disposed in the light-pervious lampshade 21 and located at the center of the light-pervious lampshade 21 or above the light-pervious lampshade 21. When the PCBA 50 is implemented, the PCBA 50 is made into a suitable shape corresponding to the shape and internal space of a different lamp holder 20, such as a ring, a strip, a disk, a triangle, or a non-geometry. As shown in FIG. 1 and FIG. 2, the PCBA 50 is in the form of a strip, as an example.

Figure 3:
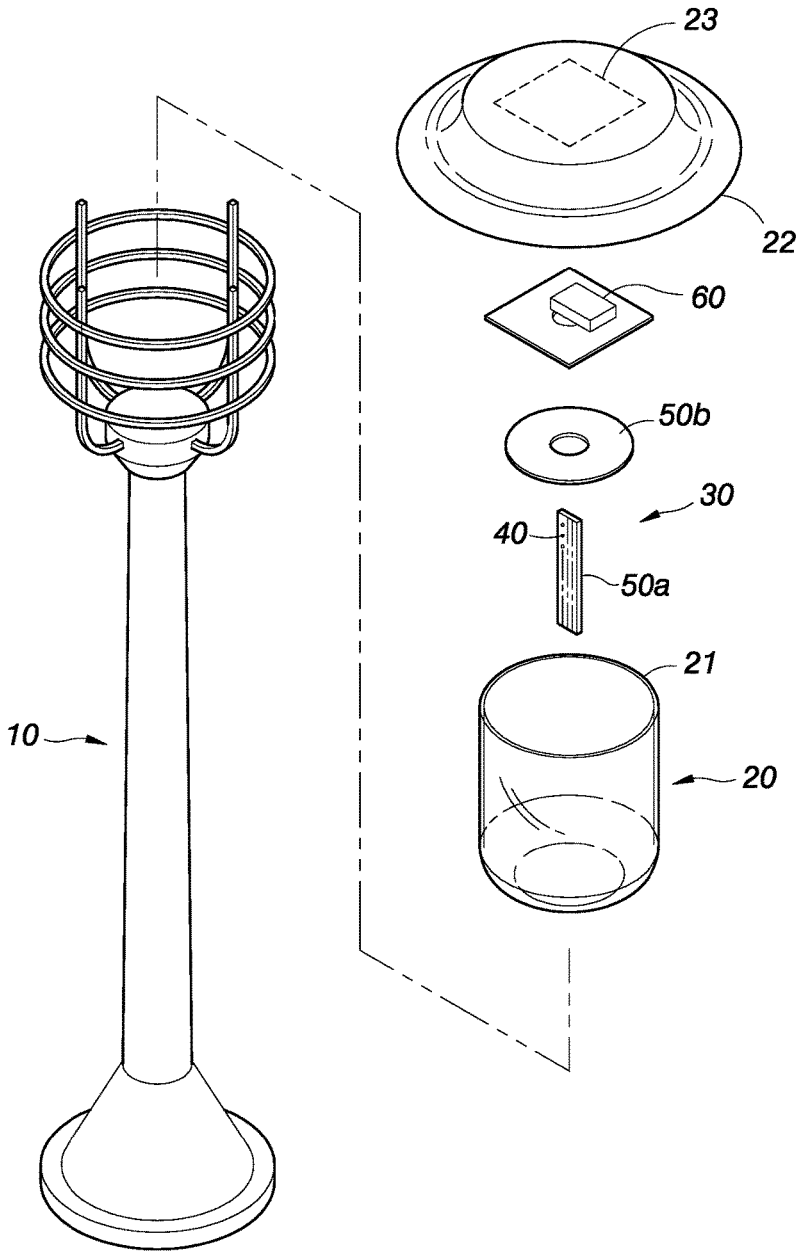
FIG. 3 is an exploded view of the outdoor lamp in accordance with another embodiment of the present invention.
Figure 4:
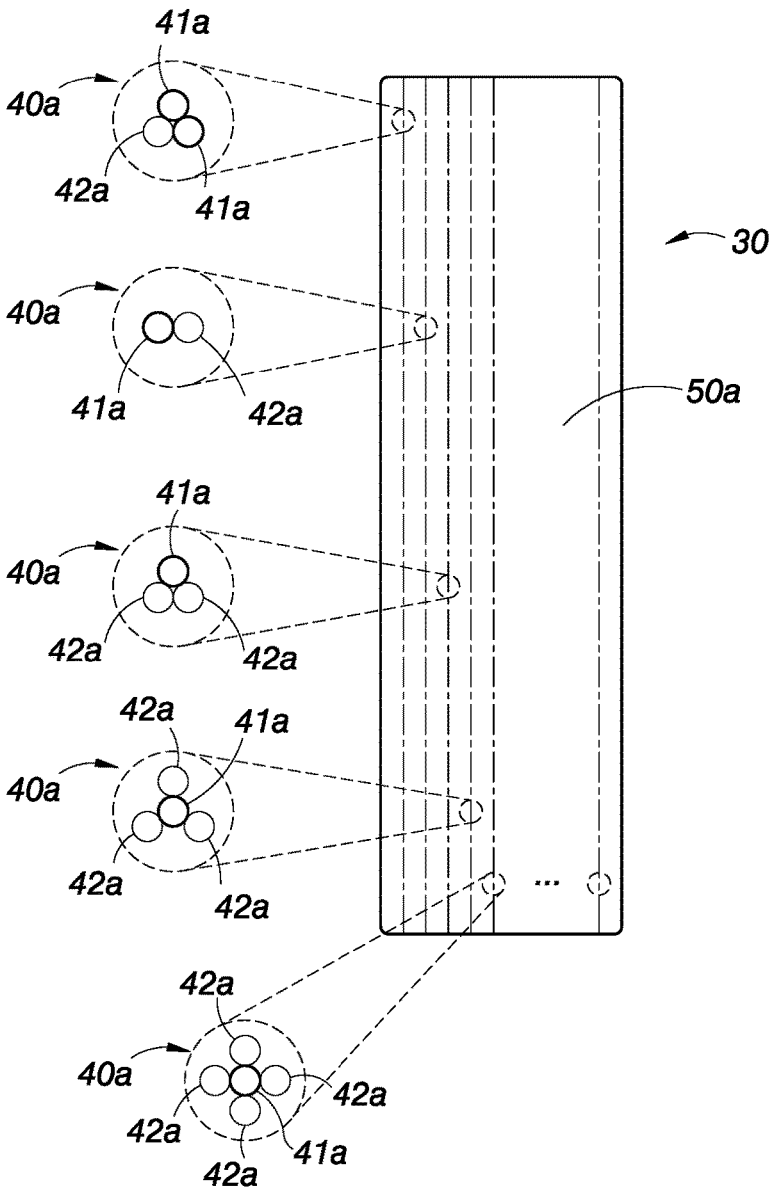
FIG. 4 is a schematic view showing the LED groups arranged in a rectangular array on the first PCBA of the present invention.
Figure 5:
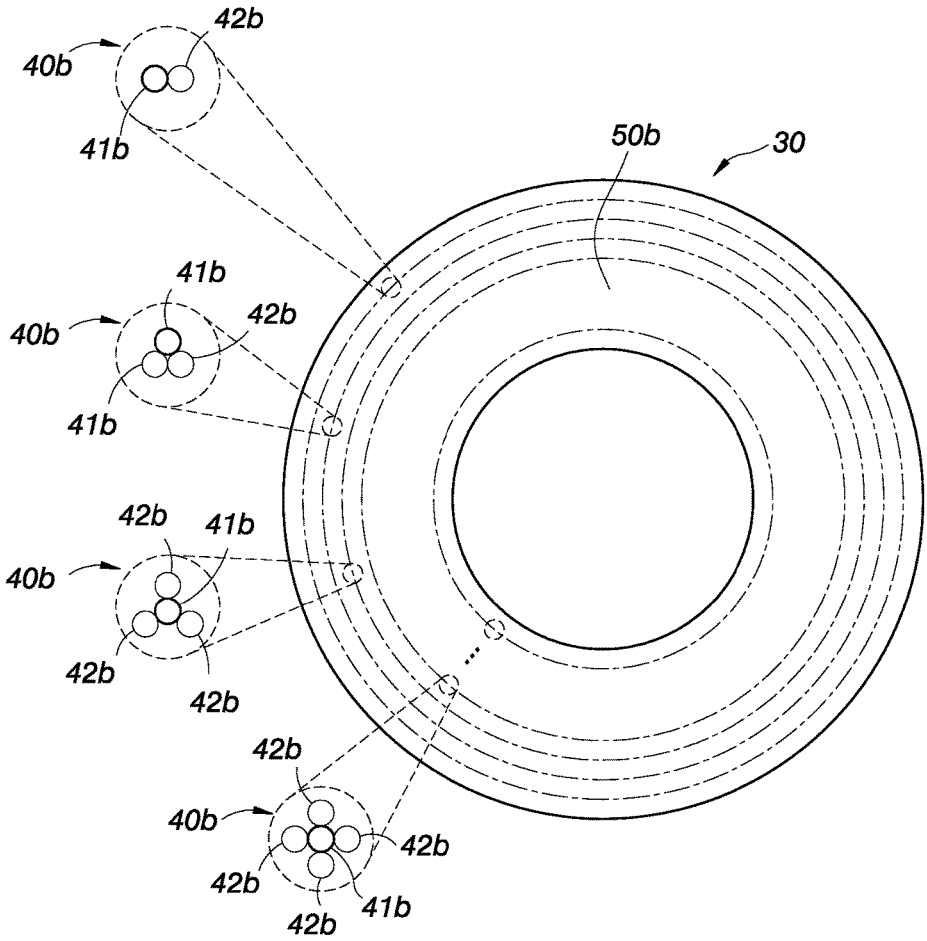
FIG. 5 is a schematic view showing the LED groups arranged in an annular array on the second PCBA of the present invention.

As shown in FIG. 3 to FIG. 5, the LED light module 30 may include two PCBAs, defined as a first PCBA 50*a* located at the center of the light-pervious lampshade 21 and a second PCBA 50*b* disposed above the first PCBA 50*a*. Both the first PCBA 50*a* and the second PCBA 50*b* may be simultaneously installed, or one of them may be selected in conjunction with the design of the outdoor lamp. In addition, as shown in FIG. 3 to FIG. 5, the first PCBA 50*a* is in the form of a strip and the second PCBA 50*b* is in the form of a ring, as an example. But, the actual implementation of the first PCBA 50*a* and the second PCBA 50*b* can be respectively formed into suitable shapes according to the shapes and the internal spaces of different lamp holders.

Wherein, the first PCBA 50*a* is installed at the center of the light-pervious lampshade 21 of the lamp holder 20 in an upright manner. Both sides of the first PCBA 50*a* are provided with a plurality of LED groups 40*a*. When the LED groups 40*a* on both sides of the first PCBA 50*a* emit light, the light is scattered 360 degrees around the entire light-pervious lampshade 21 through a light guide structure in the light-pervious lampshade 21. Alternatively, a light guide pillar 51 is provided between the outside of the first PCBA 50*a* and the light-pervious lampshade 21. The light is scattered 360-degree through the light guide pillar 51. The light guide structure or the light guide pillar 51 in the light-pervious lampshade 21 is a general technique and won't be further described hereinafter.

As shown in the figures, the second PCBA 50*b* of the LED light module 30 is transversely disposed under the cover 22 of the lamp holder 20, that is, above the first PCBA 50*a*. A plurality of LED groups 40*b* are disposed on the underside of the second PCBA 50*b* to emit light toward the light-pervious lampshade 21. If the second PCBA 50*b* is separately provided, a plurality of LED groups 40*b* are provided on both sides of the second PCBA 50*b*, enabling both sides of the second PCBA 50*b* to emit light. In cooperation with the two embodiments of the PCBA, the implementation of the LED groups of the present invention is as follows:

As shown in FIG. 4, the first PCBA 50*a* is in the form of a strip, and the plurality of LED groups 40*a* are arranged in a rectangular array. Wherein, each LED group 40*a* is composed of at least one white/warm white LED 41*a* and at least one RGB LED 42*a* adjacent to each other. The LED driver can drive and control each of the white/warm white LED 41*a* and the RGB LED 42*a* to emit light simultaneously or individually. When the RGB LED 42*a* emits light in a fixed color manner or in a color-changing manner, the luminous flux of the entire LED light module 30 is increased through the white light/warm white light emitted by each white/warm white LED 41*a*.

It is worth mentioning that the number of at least one white/warm white LED 41*a* and at least one RGB LED 42*a* of the LED group 40*a* may be configured in different numbers depending on the needs of the lighting effect. For example, as shown in FIG. 4, the white/warm white LEDs 41*a* and the RGB LEDs 42*a* of the LED groups 40*a* are arranged from the left to the right of the figure: two white/warm white LEDs 41*a* in cooperation with one RGB LED 42*a*, one white/warm white LED 41*a* in cooperation with one RGB LED 42*a*, one white/warm white LED 41*a* in cooperation with two RGB LEDs 42*a*, etc., or many white/warm white LEDs 41*a* in cooperation with many RGB LEDs 42*a*, thereby enabling the colored light emitted by the entire LED light module 30 to have a color gradient effect.

As shown in FIG. 5, the LED groups 40*b* on the second PCBA 50*b* are arranged in an annular array. Each LED group 40*b* is composed of at least one white/warm white LED 41*b* and at least one RGB LED 42*b* adjacent to each other. As for the configuration of the white/warm white LED 41*b* and the RGB LED 42*b*, the RGB LED 42*b* can be configured to increase in number from the outside to the inside. The luminous flux of the entire LED light module 30 can be increased through the white light/warm white light emitted by each white/warm white LED 41*b*. Through the change in number, the colored light emitted by the entire LED light module 30 may have a color gradient effect.

For example, the LED groups 40*b* arranged in an annular array as shown in the figure, the number of white/warm white LEDs 41*b* is one or more from the outside to the inside, but the number of RGB LEDs 42*b* gradually increases from the outside to the inside. Through the control of the LED driver, it is possible to generate a color gradient effect in which the color gradually becomes richer from the outside to the inside.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An outdoor lamp capable of changing colors, comprising a support member, a lamp holder disposed on the support member and an LED light module disposed in the lamp holder, the LED light module including at least one PCBA (printed circuit board assembly) arrayed with a plurality of LED groups, the PCBA being electrically connected to an LED driver, characterized by:

each of the LED groups being composed of at least one white/warm white LED and at least one RGB LED adjacent to each other, the LED driver driving and controlling each of the white/warm white LED and the RGB LED to emit light simultaneously or individually; wherein when the LED driver drives and controls the RGB LED to emit light in a fixed color manner or in a color-changing manner, luminous flux of the LED light module is increased through white light/warm white light emitted by the white/warm white LED.

2. The outdoor lamp capable of changing colors as claimed in claim 1, wherein the lamp holder includes a light-pervious lampshade disposed on a top of the support member and a cover configured to cover a top of the light-pervious lampshade, and the PCBA is disposed in the light-pervious lampshade or under the cover.

3. The outdoor lamp capable of changing colors as claimed in claim 1, wherein the support member has a bottom portion in the form of a rod to be fixed to the ground.

4. The outdoor lamp capable of changing colors as claimed in claim 2, wherein a top of the cover is provided with a solar panel, and the LED driver is disposed between the top of the light-pervious lampshade and the cover.

5. The outdoor lamp capable of changing colors as claimed in claim 1, wherein the PCBA is in the form of a ring, a strip, a disk, a triangle or a non-geometry.

6. The outdoor lamp capable of changing colors as claimed in claim 2, wherein the PCBA is in the form of a strip and disposed in the light-pervious lampshade in an upright manner, the plurality of LED groups are arranged in a rectangular array on one side or two sides of the PCBA, enabling the side or the two sides of the PCBA to emit light.

7. The outdoor lamp capable of changing colors as claimed in claim 2, wherein the PCBA is transversely disposed under the cover, and the plurality of LED groups are arranged in an annular array on one side or two sides of the PCBA, enabling the side or the two sides of the PCBA to emit light.

8. The outdoor lamp capable of changing colors as claimed in claim 7, wherein the number of the RGB LED in each of the LED groups of the annular array gradually increases from the outside to the inside to generate a color gradient effect.

9. The outdoor lamp capable of changing colors as claimed in claim 2, wherein the PCBA includes a first PCBA and a second PCBA, the first PCBA is disposed in the light-pervious lampshade in an upright manner, the plurality of LED groups are arranged in a rectangular array on two sides of the first PCBA, enabling the two sides of the first PCBA to emit light; the second PCBA is transversely disposed under the cover, and the plurality of LED groups are arranged in an annular array on an underside of the second PCBA.

10. The outdoor lamp capable of changing colors as claimed in claim 9, wherein the number of the RGB LED in each of the LED groups of the annular array gradually increases from the outside to the inside to generate a color gradient effect.

* * * * *